US006478031B1

(12) United States Patent
Smith

(10) Patent No.: US 6,478,031 B1
(45) Date of Patent: Nov. 12, 2002

(54) LEDGER FOR CIGARETTE MAKING MACHINE CUT-OFF

(75) Inventor: Michael Norman Smith, High Wycombe (GB)

(73) Assignee: Molins PLC, Milton Keynes (GB)

( * ) Notice: Subject to any disclaimer, the term of this patent is extended or adjusted under 35 U.S.C. 154(b) by 0 days.

(21) Appl. No.: 09/230,357

(22) PCT Filed: Jul. 23, 1997

(86) PCT No.: PCT/GB97/02004

§ 371 (c)(1),
(2), (4) Date: Nov. 5, 1999

(87) PCT Pub. No.: WO98/04161

PCT Pub. Date: Feb. 5, 1998

(30) Foreign Application Priority Data

Jul. 25, 1996 (GB) ..... 9615678

(51) Int. Cl.[7] ..... A24C 5/28; B23D 25/00; F16H 3/08

(52) U.S. Cl. ..... 131/84.4; 131/63; 131/65; 83/310; 74/331; 74/395

(58) Field of Search ..... 83/310, 438, 926; 131/84.1, 84.2, 84.3, 84.4, 906, 65, 63; 74/395, 331, 336

(56) References Cited

U.S. PATENT DOCUMENTS 3,760,672 A * 9/1973 Labee et al. ..... 83/310
3,902,376 A * 9/1975 Humphrey ..... 74/217
4,036,074 A * 7/1977 Bodnar ..... 74/409
4,286,476 A * 9/1981 Stiff ..... 74/640
4,444,210 A 4/1984 Schumacher
4,534,252 A * 8/1985 Harrington et al. ..... 83/310
4,537,205 A * 8/1985 Verjux ..... 131/280
5,816,261 A * 10/1998 Dyett ..... 131/84.4

* cited by examiner

*Primary Examiner*—Steven P. Griffin
*Assistant Examiner*—Carlos Lopez
(74) *Attorney, Agent, or Firm*—Antonelli, Terry, Stout & Kraus, LLP

(57) ABSTRACT

This invention is concerned with improvements to a ledger for a rod-making machine of the type comprising a rod supporting part (14, 16) which is pivotally mounted on two linear motion devices (10; 12) each comprising a fixed gear (A), a first orbiting gear (B) which is preferably smaller than the fixed gear, and a pair of connected coaxial gears (C) and (D) of different diameter which also orbit about the axis of the fixed gear and which mesh respectively with the fixed gear and first orbiting gear (B), such that the effective gear ratio between the fixed gear (A) and the first orbiting gear (B) via the other two gears is 2:1, the rod supporting part being pivotally connected to the first orbiting gear (B) or to a crank connected thereto. According to the main improvement, an assembly including gears B, C and D and parts carrying them at appropriate positions is arranged to be readily replaceable to achieve a rod length change.

10 Claims, 4 Drawing Sheets

LEDGER FOR CIGARETTE MAKING MACHINE CUT-OFF

Cigarette making machines commonly operate by forming a continuous rod which is then cut into discrete lengths by a cut-off device while the rod is being supported by what is commonly termed a "ledger". Such ledgers commonly have an oscillating motion and contact the rod only at a top-dead-centre position of the ledger, but refinements have been proposed whereby the part of the ledger which supports the rod moves with a more nearly linear oscillating motion. Oscillating ledgers, however, tend to be noisy. With a view to reducing the noise there have been proposals involving purely rotary motions whereby the part of the ledger which supports the rod during cutting is momentarily in contact with the rod; this has a disadvantage in that the rod-supporting part cannot be tubular, but must instead be U-shaped so as to be able to move towards and away from the rod.

Another possibility is described in our British patent No. 2108820, in which FIG. 1 shows a ledger whereby linear motion of a rod-supporting part is produced by pivotally connecting opposite ends of that part to two devices each consisting of an internal gear within which orbits an external gear which is half the diameter of the internal gear. This arrangement has a number of practical disadvantages, amongst which is the fact that it does not lend itself to rod length adjustment.

The above-mentioned patent also shows, in FIG. 3, a ledger comprising mainly rotary parts but which nevertheless produce linear motion of the rod-supporting part, and allows for changes in the rod length.

In general terms such a ledger (the reference letters being as used in this specification) comprises a rod-supporting part which is pivotally mounted on two linear motion devices each comprising a fixed gear (A), a second gear (B) which is preferably smaller than the fixed gear and which orbits about the axis of the fixed gear, and a pair of connected coaxial gears (C) and (D) of different diameter which also orbit about the axis of the fixed gear and which mesh respectively with the fixed gear and first orbiting gear (B), such that the effective gear ratio between the fixed gear (A) and the first orbiting gear (B) via the other two gears is 2:1, the rod supporting part being pivotally connected to the first orbiting gear (B) or to a crank connected thereto. The present invention is concerned with various improvements to such a ledger.

The distance between the axis (Ac) of the fixed gear and the axis (Bc) of the first orbiting gear should be equal to the distance between the axis (Bc) of the first orbiting gear and the pivot axis (P) by which the rod supporting part is pivotally connected to the first orbiting gear. These distances can be changed in order to change the rod length. The rod length (i.e. the intervals between successive cuts of the continuous rod) is related to the distance AcBc and BcP as follows:

$$AcBc=BcP=\text{Rod Length divided by } 4\pi$$

The rod length referred to is twice the length of the tobacco-filled rod of each cigarette; double length portions are usually cut by the cut-off of the cigarette making machine, and are subsequently cut into two equal portions in the associated filter attachment machine. For example, for a rod length of 140 mm (for average-length cigarettes having a 70 mm tobacco rod) the distance AcBc and BcP would each be 11.14 mm.

The distances AcBc and BcP may in theory be made adjustable, as described in our above-mentioned patent, but only with difficulty. Instead, according to one aspect of the present invention, an assembly comprising the parts determining those distances is designed to be interchangeable. Those parts which need to be changed in order to achieve a different rod length are described below in the specific description with reference to the drawings.

According to another aspect of the present invention, the rod-supporting part comprises two members having adjacent ends pivotally connected to one another and being pivotally connected at their other ends to the respective linear motion devices. The two members are preferably substantially identical, being mirror images of one another, each having a tube-like portion through which the cigarette rod is arranged to pass and by which the rod is supported, the cut-off knife being arranged to pass between the two tube-like portions during each cutting operation.

This aspect of the invention avoids the generation of excessive bending stresses in the rod supporting part which can occur if the rod supporting part is in one piece.

Other aspects of this invention include, for example, the provision described below for setting up each linear motion device by means of a jig following the introduction of change parts in order to change the rod length.

An example of a ledger including all aspects of this invention is shown in the accompanying drawings.

In these drawings:

FIGS. 1 to 3 illustrate the principal upon which a ledger according to the present invention is based. Each of the arrangements shown in FIGS. 1 to 3 is basically disclosed in our patent GB 2108820.

Figure 1:
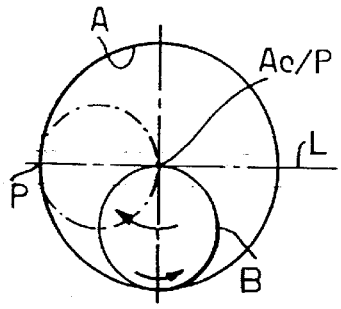
FIG. 1 shows diagrammatically a known gear arrangement for producing a linear motion.

As shown in FIG. 1, linear motion of a point P on a gear B is produced when the gear B orbits around the inside of an internal gear A The centre Ac of the gear A is in a fixed position; while the centre Bc of the gear B moves along a circular path around centre Ac. FIG. 1 shows the gear B in solid outline at the position at which P and Ac coincide (ie at the midpoint of the stroke of P along a line L) and in chain dotted outline at one end of the stroke of point P.

Figure 2:
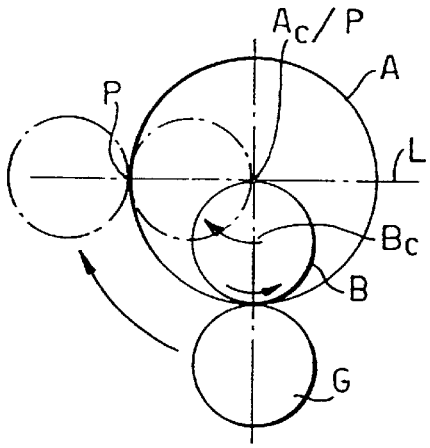
FIG. 2 shows a modified form of the gear arrangement of FIG. 1 using entirely external gears.
Figure 2A:
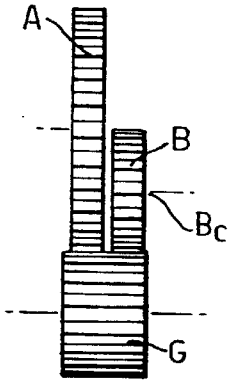
FIG. 2A is a view from the left of FIG. 2.

FIG. 2 shows an arrangement which achieves the same result, but with external gears. Again there is a fixed gear A and an orbiting gear B on which a point P moves with linear motion along line L. This is achieved by means of a planetary gear G which is carried by a crank (not shown) rotating about Ac and arranged to carry also the gear B. Gear G can be of any size, but the ratio A:B must be equal to 2:1. As in FIG. 1, the gears B and G are shown in solid outline in positions at which the point P coincides with Ac, and in chain dotted outline in positions at which the point P is at one end of its linear stroke.

Figure 3A:
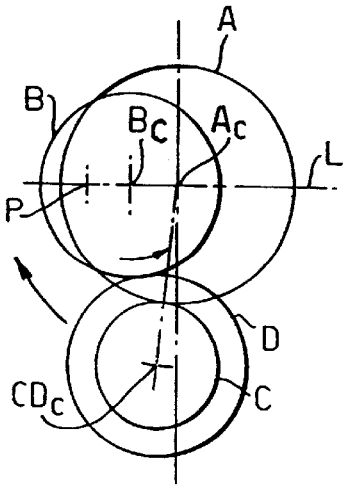
FIG. 3A shows diagrammatically a gear arrangement according to the present invention in one position.
Figure 3B:
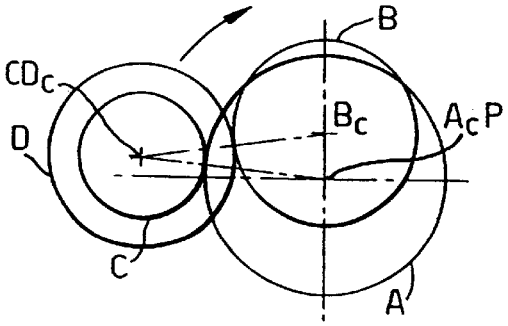
FIG. 3B shows the same gear arrangement as in FIG. 3A, but in a different position.

FIGS. 3A and 3B show different positions of a linear-motion device comprising again a fixed gear A, a first orbiting gear B on which a point P moves with linear motion, and a pair of additional orbiting gears C and D which are connected coaxially together and mesh respectively with the gears A and B. The gears B, C and D orbit about the axis Ac by virtue of being carried by a member (not shown) which rotates about the axis Ac. The distance of Bc (the centre of gear B) from Ac must be equal to the distance of point P from Bc. Moreover, in order to achieve a 2:1 gear ratio between the gears A and B, the gears C and D must have an appropriate ratio. For example, the number of gear teeth on the gears A to D may be respectively 40,28,42 and 30. Thus the effective gear ratio of A:B is equal to 40÷28×42÷30=2.

FIG. 3A shows the gears in the positions at which the point P is at one end of its linear motion stroke along the line L, while FIG. 3B shows the gears at the position at which the point P coincides with Ac: that is to say, is at the midpoint of its stroke.

Figure 5:
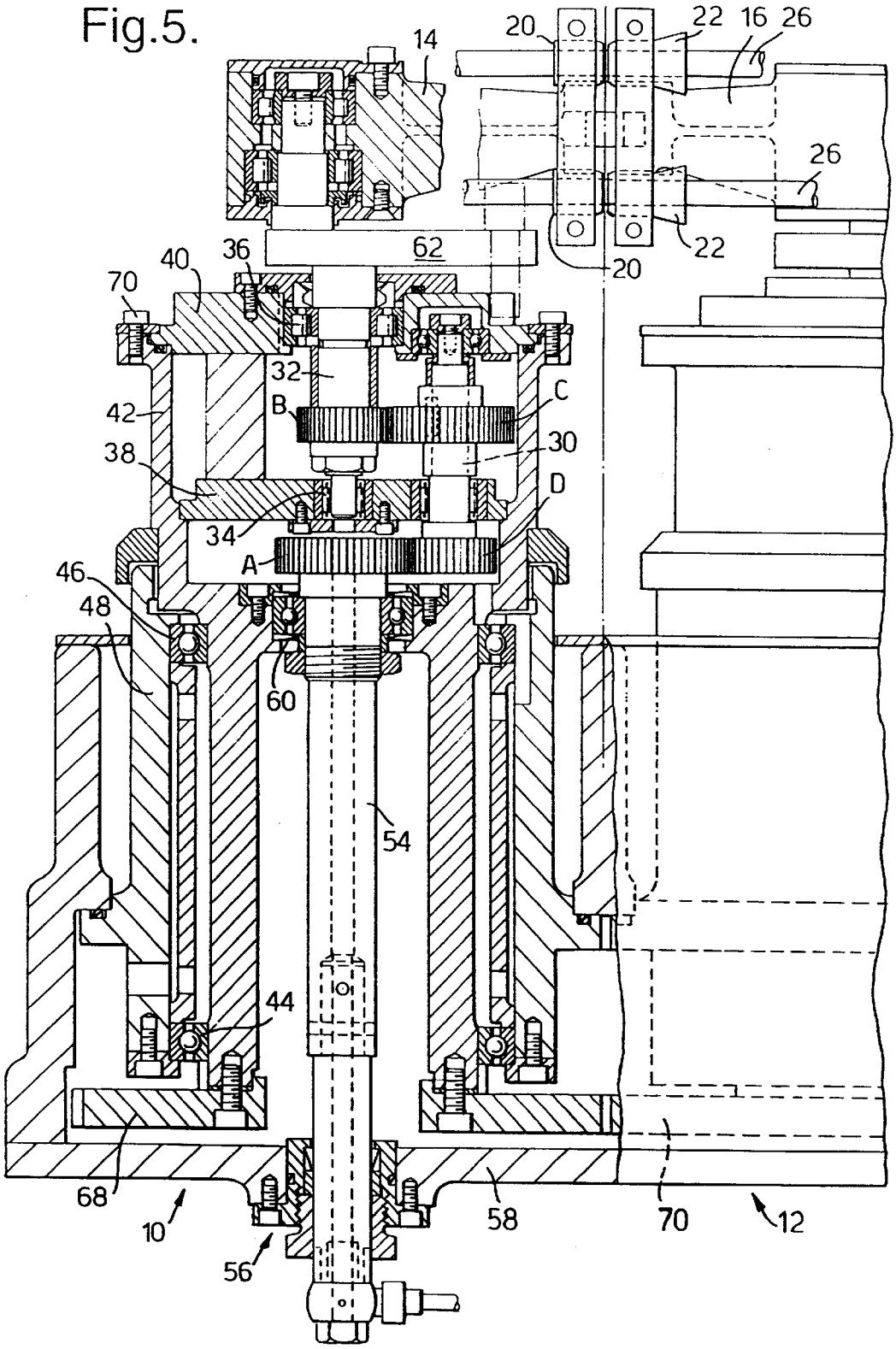
FIG. 5 is a diagrammatic longitudinal section through one of the linear-motion gear arrangements.
Figure 6:
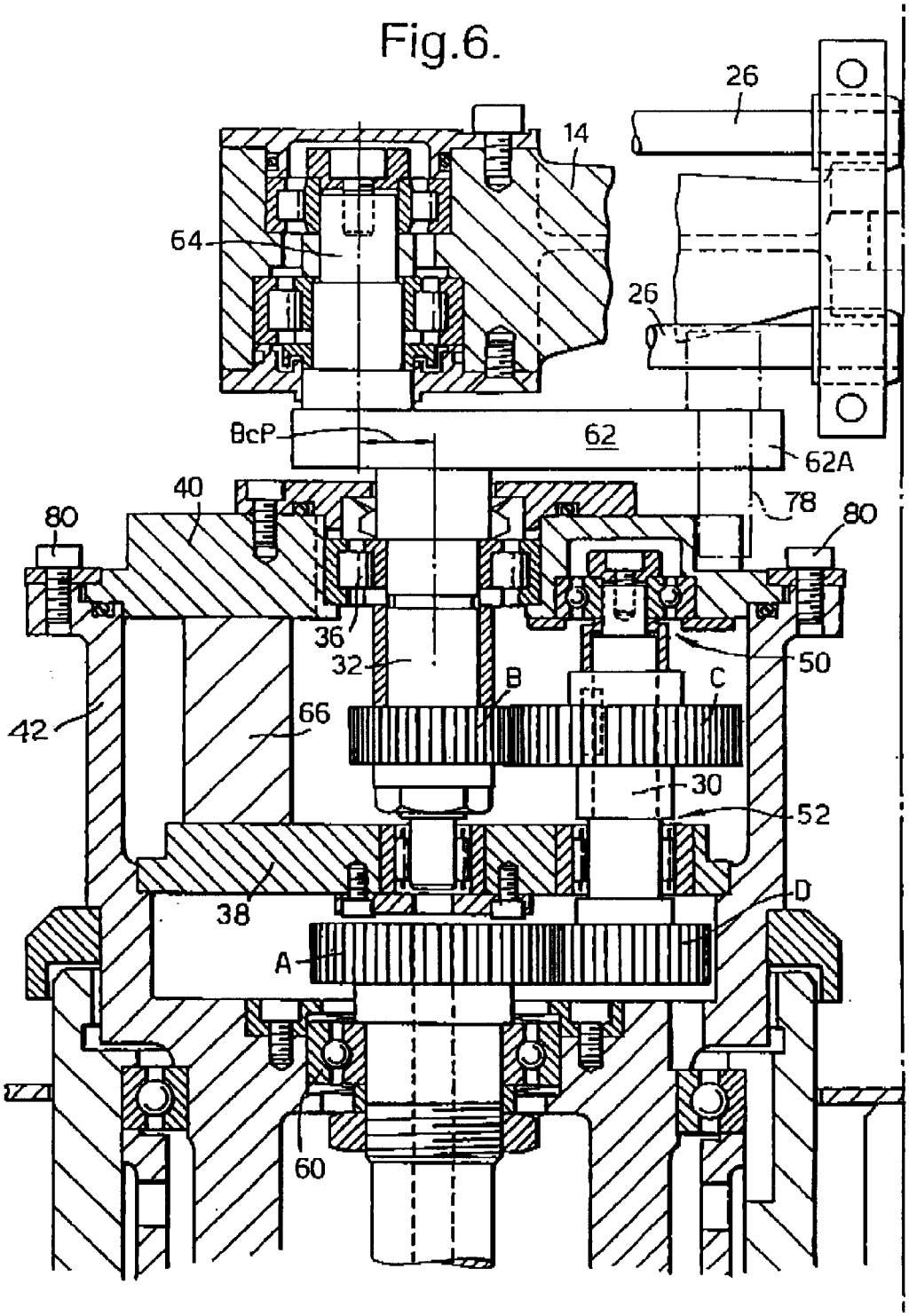
FIG. 6 is an enlargement of part of FIG. 5.

In the example shown in FIGS. 3A and 3B, the length of the stroke of point P, and hence the rod length which this device can be used to cut, can be changed by increasing or decreasing the distance AcBc and similarly the distance BcP. When that is done, in order to achieve the required meshing between the gears, the shape of the triangle represented by the points Ac, Bc and CDc (the centre of gears C and D) must be changed. According to one aspect of the present invention, that is achieved by changing the members carrying the axes of the gears B,C and D, and also a crank connected to the gear B and arranged to carry a pivot pin centred on the new point P. This is shown in FIGS. 5 and 6 which are described below.

Figure 4:
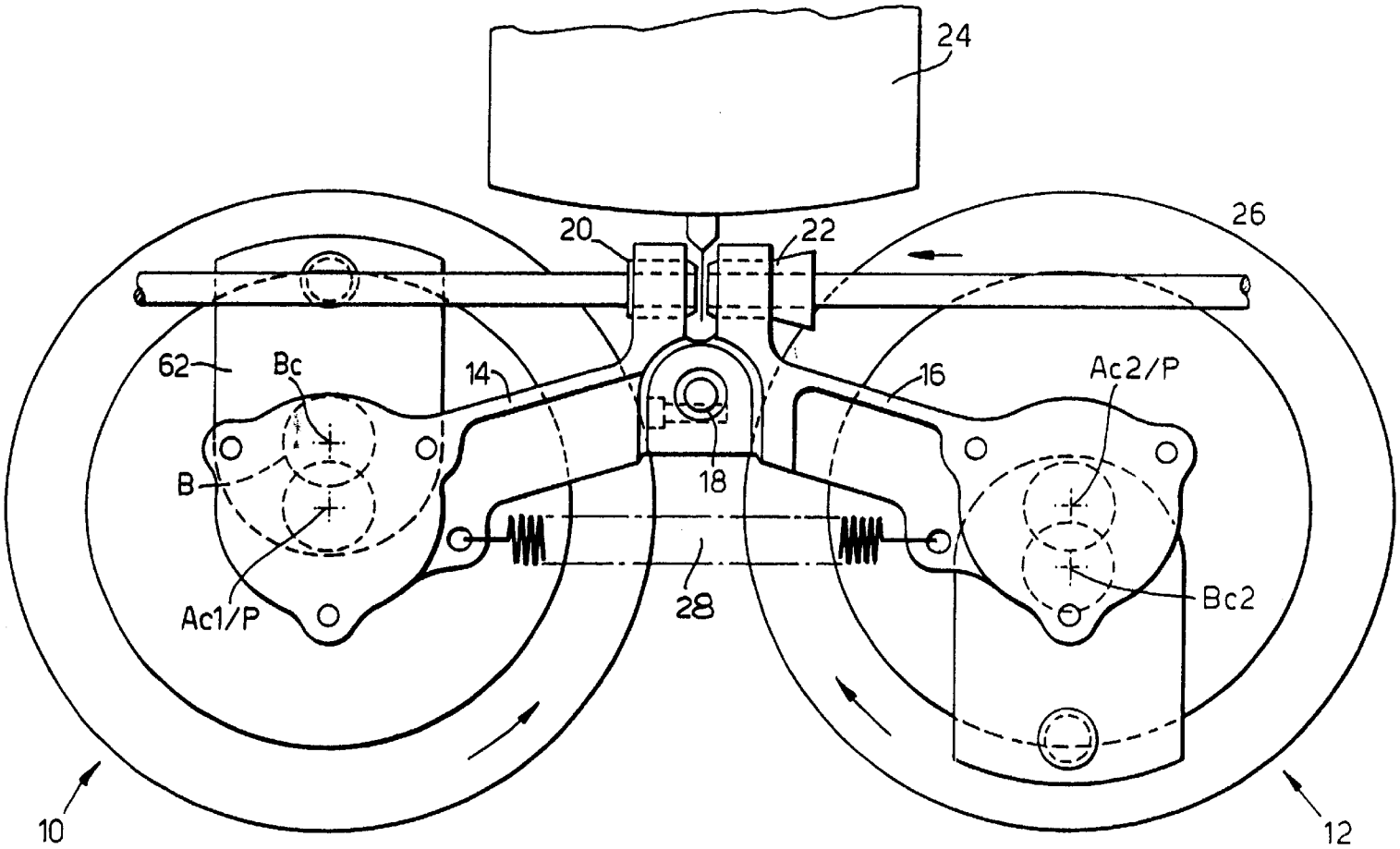
FIG. 4 is a front view of a ledger for a cigarette making machine including two gear arrangements in the form shown in FIG. 3A.

FIG. 4 shows the two linear motion devices 10 and 12 (henceforth referred to as "turrets"), and a rod-supporting part comprising members 14 and 16 pivoted respectively to the turrets 10 and 12 and pivotally connected to one another by a pivot pin 18. The axis of the pin 18 lies directly below a gap between two tubular parts 20 and 22 carried respectively by the members 14 and 16. FIG. 4 also shows diagrammatically a rotary cut-off head 24 carrying a knife which, in the position shown, is in the process of passing between the adjacent ends of the tubular members 20 and 22 so as to cut a cigarette rod 26. While cutting the rod, the knife (in a well-known manner) moves in the direction of the rod as well as transversely through the rod.

The members 14 and 16 are also connected by an anti-backlash spring 28. This feature is an important aspect of this invention in its own right. It helps to ensure that the position of the ledger during rod cutting is precisely located and is not subject to variation on account of backlash in the gears. This is important because it is desirable to make the gap between the tubular members 20,22 supporting the rod as small as reasonably possible in order to achieve good, precise cuts. For example, the gap may be about 1 mm.

The ledger is shown in the position at which the linearly reciprocating rod supporting parts 20 and 22 are at the mid-point of their stroke. In this particular example, this occurs when the axis of centre Bc of the gear B of turret 10 is directly above the axis Ac1 of turret 10, while the axis Bc2 of the corresponding gear B in turret 12 is directly below the axis Ac2 of the gear A in turret 12. The reason for this is that the turrets rotate in opposite directions, which is preferred as it improves the dynamic balance of the ledger If, instead, the turrets were to rotate in the same direction, then at the midpoint of the stroke of the ledger Bc and Bc2 would both be either directly above or directly below the axes Ac1 and Ac2.

FIG. 5 is a longitudinal section through the turret 10. It also shows that, for use in a twin-track cigarette making machine, each of the rod-supporting members 14 and 16 carries a pair of tubular members 20 or 22 for supporting a pair of cigarette rods 26 during cutting.

Like FIG. 4, FIG. 5 shows the turret 10 in the position corresponding to the midpoint of the stroke of the ledger. Thus, the axis Bc of the orbiting gear B appears to be aligned with that of the fixed gear A; it is in fact directly above the axis Ac1, as shown in FIG. 4. Gears C and D meshing respectively with the gears A and B (as described with reference to FIGS. 3A and 3B) are mounted on and keyed to a shaft 30. The gear B is mounted on and keyed to a shaft 32 which rotates in bearings 34 and 36 located respectively in circular plates 38 and 40 lying within a generally cylindrical housing 42. The housing 42 rotates with the plates 38 and 40, being mounted in bearings 44 and 46 within a fixed casing 48.

The plates 38 and 40 also carry bearings 50 and 52 (see FIG. 6) supporting the ends of the shaft 30 on which the gears C and D are mounted. A central shaft 54 which carries the gear A is normally fixed in position by a releasable locking device 56 by which the shaft is locked with respect to a fixed end plate 58 which extends across both turrets. A further bearing 60 is located between the shaft 54 and an intermediate portion of the rotatable casing 42.

A crank 62 is mounted on one end of the shaft 32 carrying the gear B, and this crank in turn carries a stub shaft 64 (FIG. 6) on which one end of the corresponding rod supporting member 14 is pivotally mounted via bearings as shown. In other words, the axis of the shaft 64 represents the point P in FIGS. 3A and 3B.

For the purpose of illustration, the axis of the stub shaft 64 (point P in FIG. 3B) is shown to the left of the axis of the gear A and shaft 54, but in practice the axis of shaft 64 would at this stage coincide with that of gear A and shaft 54.

For the purpose of balancing, a portion 62A (FIG. 6) of the crank extends in a direction away from a portion carrying the stub shaft 64. Furthermore, a member 66 connected between the plates 38 and 40 (on the side opposite to the shaft 30 carrying the gears C and D) is provided for further balancing of the mechanism.

A drive to the rotating parts of the turret 10 is provided by a gear 68 which meshes with a similar gear 70 in the turret 12. An external drive (not shown) via bevel gears is provided to the gear 70, which in turn drives the gear 68 in the opposite direction.

When a rod length change is required, this is achieved (after removing the rod supporting member 14 from the stub shafts 64 of both turrets) by replacing the gear assembly comprising the plates 38 and 40, the shafts 30 and 32, the gears B,C and D on these shafts, and the crank 62, together with the stub shaft 64. This assembly is replaced by a similar assembly including identical gears differently positioned so as to provide a different distance BcP and AcBc, these distances again being equal. The different balance requirements called for by the new gear assembly are also taken into account in that the crank 62 is appropriately shaped, and a different balance weight 66 (larger and/or differently positioned) is incorporated.

While in theory it is possible to change the rod length by means of manual adjustments, in practice that would be very difficult to achieve that satisfactorily. Moreover, the provision according to the present invention whereby the entire gear assembly can be changed to produce a different rod length also allows for automatic compensation to be made to satisfy the new balancing requirements. Thus all that is needed to achieve a different rod length is the replacement of the gear assembly, followed by an aligning procedure which would be necessary in any case. This aligning procedure is achieved for each of the turrets 10 and 12 by locking the crank 62 to the plate 40 by means of a removable pin 78 (shown in chain-dotted outline in FIG. 6), releasing the device 56 by which the shaft 54 is clamped in position, and releasing a series of circumferentially spaced screws 80 by which the plate 40 is normally locked with respect to the housing 42. The central assembly of the turret is then rotated until the parts are in the positions appropriate to the mid-stroke position of the ledger, as determined for convenience by means of a suitable jig. The other turret is treated similarly. Once this phasing adjustment has been made, the locking pin 78 is removed, the screws 80 are tightened, and the shaft clamping device 56 is operated to clamp in position the shaft 54.

What is claimed is:

1. A ledger for supporting a cigarette rod during cutting in a cigarette making machine, said ledger comprising a rod-supporting part which is pivotally mounted on two linear motion devices, wherein each linear motion device comprises a fixed gear, a first orbiting gear which is arranged to orbit about an axis of the fixed gear, and a pair of connected coaxial gears, which also orbit about the axis of the fixed gear and which mesh respectively with the fixed gear and first orbiting gear such that an effective gear ratio between the fixed gear and the first orbiting gear via said coaxial gears is 2:1, the rod supporting part being pivotally connected to the first orbiting gear, or to a crank connected thereto, of each linear motion device, said first orbiting gear and said pair of connected coaxial gears in each linear motion device forming part of a removable assembly providing a different cigarette rod length configuration, in which each removable assembly includes a pair of plates arranged to support shafts carrying said first orbiting gear and said coaxial gears of the assembly in relative positions appropriate for the corresponding cigarette rod length.

2. A ledger according to claim 1, in which one of the plates of each linear motion device is releasably clamped to a cylindrical housing which forms a rotatable part of the linear motion device.

3. A ledger according to claim 2, in which each linear motion device is driven via a gear formed or mounted on the corresponding cylindrical housing.

4. A ledger for supporting a cigarette rod during cutting in a cigarette making machine, said ledger comprising a rod-supporting part which is pivotally mounted on two linear motion devices, wherein each linear motion device comprises a fixed gear, a first orbiting gear which is arranged to orbit about an axis of the fixed gear, and a pair of connected coaxial gears, which also orbit about the axis of the fixed gear and which mesh respectively with the fixed gear and first orbiting gear such that an effective gear ratio between the fixed gear and the first orbiting gear via said coaxial gears is 2:1, the rod supporting pan being pivotally connected to the first orbiting gear, or to a crank connected thereto, of each linear motion device, said first orbiting gear and said pair of connected coaxial gears in each linear motion device forming part of a removable assembly providing a different cigarette rod length configuration, in which each assembly includes a crank carrying a stub shaft by which one end of the rod-supporting part is pivotally connected the linear motion device at a position appropriate for the corresponding cigarette rod length.

5. A ledger for supporting a cigarette rod during cutting in a cigarette making machine, said ledger comprising a rod-supporting part which is pivotally mounted on two linear motion devices, wherein each linear motion device comprises a fixed gear, a first orbiting gear which is arranged to orbit about an axis of the fixed gear, and a pair of connected coaxial gears, which also orbit about the axis of the fixed gear and which mesh respectively with the fixed gear and first orbiting gear such that an effective gear ratio between the fixed gear and the first orbiting gear via said coaxial gears is 2:1, the rod supporting part being pivotally connected to the first orbiting gear, or to a crank connected thereto, of each linear motion device, said first orbiting gear and said pair of connected coaxial gears in each linear motion device forming part of a removable assembly providing a different cigarette rod length configuration, the orbiting parts of the two linear motion devices are arranged to rotate in opposite directions about the axes of the respective fixed gears.

6. A ledger for supporting a cigarette rod during cutting in a cigarette making machine, said ledger comprising a rod-supporting part which is pivotally mounted on two linear motion devices, wherein each linear motion device comprises a fixed gear, a first orbiting gear which is arranged to orbit about an axis of the fixed gear, and a pair of connected coaxial gears, which also orbit about the axis of the fixed gear and which mesh respectively with the fixed gear and first orbiting gear such that an effective gear ratio between the fixed gear and the first orbiting gear via said coaxial gears is 2:1, the rod supporting part being pivotally connected to the first orbiting gear, or to a crank connected thereto, of each linear motion device, said first orbiting gear and said pair of connected coaxial gears in each linear motion device forming part of a removable assembly providing a different cigarette rod length configuration, in the which rod-supporting part comprises two portions which are pivotally connected together and in which the two portions of the rod-supporting part are also connected together by a spring arranged to have an anti-backlash action.

7. A ledger for supporting a cigarette rod during cutting in a cigarette making machine, said ledger comprising a rod-supporting which is pivotally mounted on two linear motion devices, wherein each linear motion device comprises a fixed gear, a first orbiting gear which is arranged to orbit about an axis of the fixed gear, and a pair of connected coaxial gears which also orbit about the axis of the fixed gear and which mesh respectively with the fixed gear and first orbiting gear such that an effective gear ratio between the fixed gear and the first orbiting gear via said coaxial gears is 2:1, the rod supporting part being pivotally connected to the first orbiting gear, or to a crank connected thereto, of each linear motion device and the rod-supporting part comprising two parts having adjacent ends pivotally connected to one another and their far ends pivotably connected to the respective linear motion devices.

8. A ledger according to claim 7, in which the two parts of the rod-supporting members are also connected by a spring.

9. A ledger according to claim 8, in which the spring is arranged to provide an anti-backlash action.

10. A ledger according to claim 7, wherein said connected coaxial gears have a different diameter.

* * * * *